US006323447B1

(12) United States Patent
Kondoh et al.

(10) Patent No.: US 6,323,447 B1
(45) Date of Patent: Nov. 27, 2001

(54) ELECTRICAL CONTACT BREAKER SWITCH, INTEGRATED ELECTRICAL CONTACT BREAKER SWITCH, AND ELECTRICAL CONTACT SWITCHING METHOD

(75) Inventors: You Kondoh, Yamato; Mitsuchika Saito, Kanagawa; Yoshikatsu Ichimura, Tokyo, all of (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/646,810

(22) PCT Filed: Dec. 23, 1999

(86) PCT No.: PCT/US99/30873

§ 371 Date: Jan. 8, 2001

§ 102(e) Date: Jan. 8, 2001

(87) PCT Pub. No.: WO00/41198

PCT Pub. Date: Jul. 13, 2000

(30) Foreign Application Priority Data

Dec. 30, 1998 (JP) ..... 10-377183

(51) Int. Cl.[7] ..... H01H 29/00
(52) U.S. Cl. ..... 200/182; 200/214
(58) Field of Search ..... 200/182–236, 200/84.6, DIG. 43, DIG. 5, 506

(56) References Cited

U.S. PATENT DOCUMENTS

| | | | | |
|---|---|---|---|---|
| 1,598,874 | | 9/1926 | Phelan . | |
| 1,869,603 | * | 8/1932 | McCabe | 200/183 |
| 2,644,058 | * | 6/1953 | Loosli | 200/122 |
| 2,644,870 | * | 7/1953 | McCabe | 200/113 |
| 3,539,743 | | 11/1970 | Winter . | |
| 3,600,537 | * | 8/1971 | Twyford | 200/152 |
| 3,673,524 | * | 6/1972 | Lowry | 335/52 |
| 3,771,080 | * | 11/1973 | Remec | 335/51 |
| 3,889,086 | * | 6/1975 | Lucian | 200/192 |
| 3,904,999 | * | 9/1975 | Rich et al. | 335/52 |
| 4,103,135 | * | 7/1978 | Gomez et al. | 200/185 |

FOREIGN PATENT DOCUMENTS

| | | |
|---|---|---|
| 691693 | 6/1967 | (BE) . |
| 312051 | 5/1919 | (DE) . |
| 36-18575 | 10/1936 | (JP) . |
| 9-161640 | 10/1992 | (JP) . |

OTHER PUBLICATIONS

Simon, Jonathan et al., "A Micromechanical Relay with a THermally–Driven Mercury Micro–Drop", IEEE, 1996, pp. 515–519.

* cited by examiner

*Primary Examiner*—Paula Bradley
*Assistant Examiner*—Nhung Nguyen

(57) ABSTRACT

An electrical contact breaker switch has a cavity or space that forms first and second chambers and a plurality of channels. The switch also has at least two solid electrodes formed with electrode components exposed apart from each other within the cavity. A conductive fluid held within the cavity functions as a contact for putting the electrode components of two specific solid electrodes in a "closed" state when in contiguous form and in an "open" state when in non-contiguous form. A form modification unit, which includes the first and second chambers, modifies the form of the conductive fluid.

20 Claims, 11 Drawing Sheets

ELECTRICAL CONTACT BREAKER SWITCH, INTEGRATED ELECTRICAL CONTACT BREAKER SWITCH, AND ELECTRICAL CONTACT SWITCHING METHOD

FIELD OF THE INVENTION

The present invention relates to an electrical contact breaker switch, an integrated electrical contact breaker switch, and an electrical contact switching method in which the switching between solid electrodes is performed mechanically by means of a conductive fluid, and more particularly relates to a breaker switch, such as mechanical contact type microrelays and microswitches of high reliability, and to an integrated breaker switch or switching method thereof.

BACKGROUND OF THE INVENTION

The typical compact, mechanical contact type of relay used in the past was a lead relay. A lead relay is furnished with a lead switch, in which two leads composed of a magnetic alloy are contained, along with an inert gas, inside a miniature glass vessel. A coil for an electromagnetic drive is wound around the lead switch, and the two leads are installed within the glass vessel as either contacting or non-contacting. Usually with this type of lead relay, in a non-drive state, current does not flow through the coil, and the ends of the leads repel each other and are not in contact. In the drive state current, current flows through the coil, and the ends of the leads attract each other and make contact.

Lead relays include dry lead relays and wet lead relays. Usually with a dry lead relay, the ends (contacts) of the leads are composed of silver, tungsten, rhodium, or an alloy containing any of these, and the surfaces of the contacts are plated with rhodium, gold, or the like. The contact resistance is high at the contacts of a dry lead relay, and there is also considerable wear at the contacts. Since reliability is diminished if the contact resistance is high at the contacts or if there is considerable wear at the contacts, there have been various attempts to treat the surface of these contacts.

Reliability of the contacts may be enhanced by the use of mercury with a wet lead relay. Specifically, by covering the contact surfaces of the leads with mercury and by using capillary action, the contact resistance at the contacts is decreased and the wear of the contacts is reduced, which results in improved reliability.

In addition, because the switching action of the leads is accompanied by mechanical fatigue due to flexing, the leads may begin to malfunction after some years of use, which also diminishes reliability. Japanese Patent Publication SHO 36-18575 and Japanese Laid-Open Patent Applications SHO 47-21645 and HEI 9-161640 disclose techniques for reducing this mechanical fatigue of the leads, lowering the contact resistance at the contacts, and making the relay more compact overall.

In these publications, the switching mechanism is structured such that a plurality of electrodes are exposed at specific locations along the inner walls of a slender sealed channel that is electrically insulating. This channel is filled with a small volume of an electrically conductive liquid to form a short liquid column. When two electrodes are to be electrically closed, the liquid column is moved to a location where it is simultaneously in contact with both electrodes. When the two electrodes are to be opened, the liquid column is moved to a location where it is not in contact with both electrodes at the same time.

To move the liquid column, Japanese Laid-Open Patent Application SHO 47-21645 discloses creating a pressure differential across the liquid column. The pressure differential is created by varying the volume of a gas compartment located on either side of the liquid column, such as with a diaphragm. Japanese Patent Publication SHO 36-18575 and Japanese Laid-Open Patent Application HEI 9-161640 disclose creating a pressure differential across the liquid column by providing the gas compartment with a heater. The heater heats the gas in the gas compartment located on one side of the liquid column.

The technology disclosed in Japanese Laid-Open Patent Application 9-161640 (relating to a microrelay element) can also be applied to an integrated circuit. Also, as the technology continues to develop, this type of relay may be made even more compact and faster, as disclosed by J. Simon, et al. (A Liquid-Filled Microrelay with a Moving Mercury Drop, Journal of Microelectromechanical Systems, Vol. 6, No. 3, September 1997). Furthermore, this type of relay may no longer be gravity dependent (attitude dependent), the mercury contacts may have a much longer service life, reliability may be enhanced, and even environmental pollution during manufacturing may be kept to a minimum.

FIG. 1 is a plan view of the layout of the latch-type thermodrive microrelay elements disclosed in Japanese Laid-Open Patent Application HEI 9-161640. The microrelay elements are formed in a specific region of a semiconductor substrate 91 and include an active reservoir 921, a passive reservoir 922, and a channel 93. The active reservoir 921 and passive reservoir 922 are each provided with a plurality of cantilevered heaters 941 and 942, and the active reservoir 921 and passive reservoir 922 are connected by the channel 93. In FIG. 1, a heater support stand is provided under the heaters 941 and 942.

A microchannel region 931, having a smaller diameter than the channel 93, is formed at a location midway along the channel 93. A first channel region 932 is formed on the active reservoir 921 side of the microchannel region 931, while a second channel region 933 is formed on the passive reservoir 922 side. The first channel region 932 is connected to the active reservoir 921 via a first narrow channel 934, and the second channel region 933 is connected to the passive reservoir 922 via a second narrow channel 935. First signal electrodes 951 and 952 are exposed in the first channel region 932, and second signal electrodes 954 and 955 are exposed in the second channel region 933. The channel portion consisting of the microchannel region 931, the first channel region 932, and the second channel region 933 is filled with a liquid metal 96, which serves as a conductive fluid column.

With the microrelay in FIG. 1, the first signal electrodes 951 and 952 can be "opened" and the second signal electrodes 954 and 955 can be "closed" by heating the heater 941 to raise the internal pressure of the active reservoir 921. This internal pressure rise of the active reservoir 921 causes the liquid metal 96 to move to the second channel region 933. Similarly, the first signal electrodes 951 and 952 can be "closed" and the second signal electrodes 954 and 955 can be "opened" by heating the heater 942 to raise the internal pressure of the passive reservoir 922. This internal pressure rise of the passive reservoir 922 causes the liquid metal 96 to move to the first channel region 932.

With a conventional microrelay as shown in FIG. 1, the relay is "closed" by moving a column of conductive fluid so that the fluid is simultaneously in contact with two electrode components. The relay is "opened" by moving the column so that it is not in contact with the two electrode components at the same time. The electrical switching point corresponds to the contact between the conductive fluid and the electrode components of the solid electrodes.

With a microrelay element having a structure as shown in FIG. 1, there is the danger that the surfaces of the electrodes will become rough or that the electrode surfaces will be corroded by components of the gas inside the channel 93 in the course of switching the first signal electrodes 951 and 952 or the second signal electrodes 954 and 955. As a result, the switching action may be unstable and reliability may diminish.

SUMMARY OF THE INVENTION

Deterioration due to corrosion of the electrode component surfaces, such as caused by chemical reactions with components of the gas within the cavities, can be eliminated. Furthermore, the voltage between the electrode components can be varied if the switching of the relay is performed by modifying the form of the conductive fluid. The conductive fluid is mechanically separated to open the contact, and the separated portions are fused to close the contact. Accordingly, the mechanical separation point or fusion point of the conductive fluid is used as the electrical switching point.

An electrical contact breaker switch consistent with the present invention has a cavity, two solid electrodes, a conductive fluid and a form modification unit. Electrode components of the solid electrodes are separated apart from each other within the cavity. A conductive fluid is held in the cavity. The electrode components are in a "closed" state when the conductive fluid is in a contiguous form and in an "open" state when the conductive fluid is in non-contiguous form, i.e., separation form. Here, the term "closed state" encompasses both a case when the conductive fluid is in a completely contiguous form and when it is in an incompletely contiguous form (referred to below as "semi-contiguous form"). The electrical conductivity between the electrode components is lower when the conductive fluid is in a semi-contiguous form than when it is in a completely contiguous form (referred to below as "contiguous form").

With a switch consistent with the present invention, the cavity may include a channel for supplying the conductive fluid. The form of the conductive fluid supplied to this channel is modified. Here, "form modification" refers not only to the part of the conductive fluid being constricted and to the conductive fluid being split into two parts, but also to the part of the conductive fluid being separated and the remaining portion being further split into two parts.

It is also possible with a switch consistent with the present invention to provide, for example, a plurality of sets of solid electrodes with corresponding sets of electrode components. In this case, the conductive fluid is provided to a plurality of cavity parts (locations corresponding to the various sets of electrode components). It is preferable for the various electrode components to be structured such that they are always immersed in the conductive fluid. This structure prevents the corrosion of the electrode components.

The form modification unit modifies a conductive fluid that is in a contiguous form into a semi-contiguous or non-contiguous form by replacing part of the conductive fluid in contiguous form with a non-conductive fluid or solid. The form modification unit can remove the replacing non-conductive fluid or solid from the conductive fluid to modify the conductive fluid from a semi-contiguous or non-contiguous form into a contiguous form.

When the form modification unit makes use of a non-conductive solid to modify the form of a conductive fluid, an actuator or other such mechanism may be included in the form modification unit. When it makes use of a non-conductive fluid, such as a liquid or gas, to modify the form, a mechanism for controlling the channel internal pressure may be included, as discussed below.

When the form modification unit makes use of a non-conductive fluid to modify the form of a conductive fluid, a channel used for supplying the non-conductive fluid can be formed in the cavity. The channel, in this case, may be structured so that it communicates with the channel used for supplying the conductive fluid. A channel internal pressure control unit can be used in the form modification unit. The channel internal pressure control unit may be connected to the channel for supplying the nonconductive fluid, to the channel for supplying the conductive fluid, or to both.

When a heat control element is used in the channel internal pressure control unit, the heat control element can be, for example, a heater or a cooling/heating unit, such as a Peltier element. A mechanical pressure control unit, such as a pump that features a piezoelectric element, may also be used in the channel internal pressure control unit.

The channel internal pressure control unit typically comprises a set of two chambers. in this case, each chamber houses a mechanism for controlling the fluid, such as a heater, and is connected to the channel for supplying the conductive fluid or the channel for supplying the non-conductive fluid. Even if the channel internal pressure control unit comprises a set of two chambers, the fluid control unit may be housed in just one of these chambers.

With a device consistent with the present invention, the solid electrode can be made of tungsten, molybdenum, chromium, titanium, tantalum, iron, cobalt, nickel, palladium, platinum, or a metal containing any of these elements. Mercury, gallium, sodium-potassium, or the like can be used as the conductive fluid. If the non-conductive fluid is a gas, it may include nitrogen, argon, helium, another inert gas, a mixture of these gases, or a non-inert gas such as hydrogen. A liquid, such as a fluorocarbon, an oil, an alcohol, or water, can also be used. The decision as to what materials to use for the conductive fluid and the non-conductive fluid should take into account factors including, for example, whether the fluids chemically react with each other, whether the fluids undergo a chemical reaction with the walls of the channels, whether the conductive fluid reacts with the electrodes, and whether the non-conductive fluid reacts with the materials that make up the internal pressure control unit, such as a heater when one is housed in the internal pressure control unit.

With a device consistent with the present invention, channels for forming one or more cavities, including the channels or chambers, may be formed by laminating a plurality of substrates. These substrates can be semiconductor substrates, such as silicon, ceramic substrates, or glass substrates. When two substrates are laminated, the channels for forming the cavities can be formed in one or both of the two substrates. When three or more substrates are laminated, the grooves for forming the cavities can be formed in one or both of the substrates in surface contact with each other. Alternatively, they can be formed with communication openings in substrates positioned on the inside of the lamination. For instance, when three substrates (first, second, and third substrates) are laminated, a heater can be formed on the second substrate-side of the first substrate with no channel formed. A communication opening that will serve as a chamber can be formed in the second substrate, and a channel that will serve as a channel can be formed on the second substrate-side of the third substrate. This configuration is just one example of the various embodiments that are possible.

In the working examples given below, an electrical contact breaker switch may include two substrates combined together, such as a silicon substrate in combination with a glass substrate. The device consistent with the present invention can be manufactured using semiconductor device manufacturing technology, micromachine manufacturing technology, or some other existing technology. For instance, the chambers, the channel for supplying the conductive fluid or the channel for supplying the non-conductive fluid can be formed by a method that is used in any of the above manufacturing techniques (such as photolithography). An integrated electrical contact breaker switch, in which the devices consistent with the present invention may be integrated, can be manufactured by a combination of these manufacturing technologies, such as semiconductor device manufacturing, micromachine manufacturing, or the like.

An electrical contact switching method consistent with the present invention is a method in which the electrical switching of two electrode components, separated apart from each other within a cavity, is performed by a conductive fluid. The electrode components are put in a "closed" state by maintaining the conductive fluid in a contiguous form within the cavity, and the two electrode components are put in an "open" state by modifying the conductive fluid into a semi-contiguous form or a non-contiguous form.

To put the two electrode components in an "open" state, part of the conductive fluid in contiguous form is replaced with a non-conductive fluid or solid, which modifies the conductive fluid from a contiguous form into a semi-contiguous form or non-contiguous form. When the two electrode components in the "open" state are to be put in a "closed" state, the non-conductive fluid or solid is removed from the conductive fluid to modify the conductive fluid from a semi-contiguous form or non-contiguous form into a contiguous form. It is preferable for the electrode components to remain continuously immersed in the conductive fluid.

Consistent with the present invention, when the channel internal pressure control unit is a set of two chambers, these chambers are connected to each other by a channel, and the space inside the chambers is divided by the conductive fluid inside the channel. It is unnecessary for the spaces inside the chambers to be completely isolated. For example, the implementation of the present invention will not be affected even if there is an internal pressure differential between the chambers. Once the conductive fluid has stabilized in its position, the non-conductive fluid moves from one chamber into the other and, as a result, the internal pressure differential between the chambers is eliminated.

DESCRIPTION OF THE PREFERRED EMBODIMENT

Figure 1:
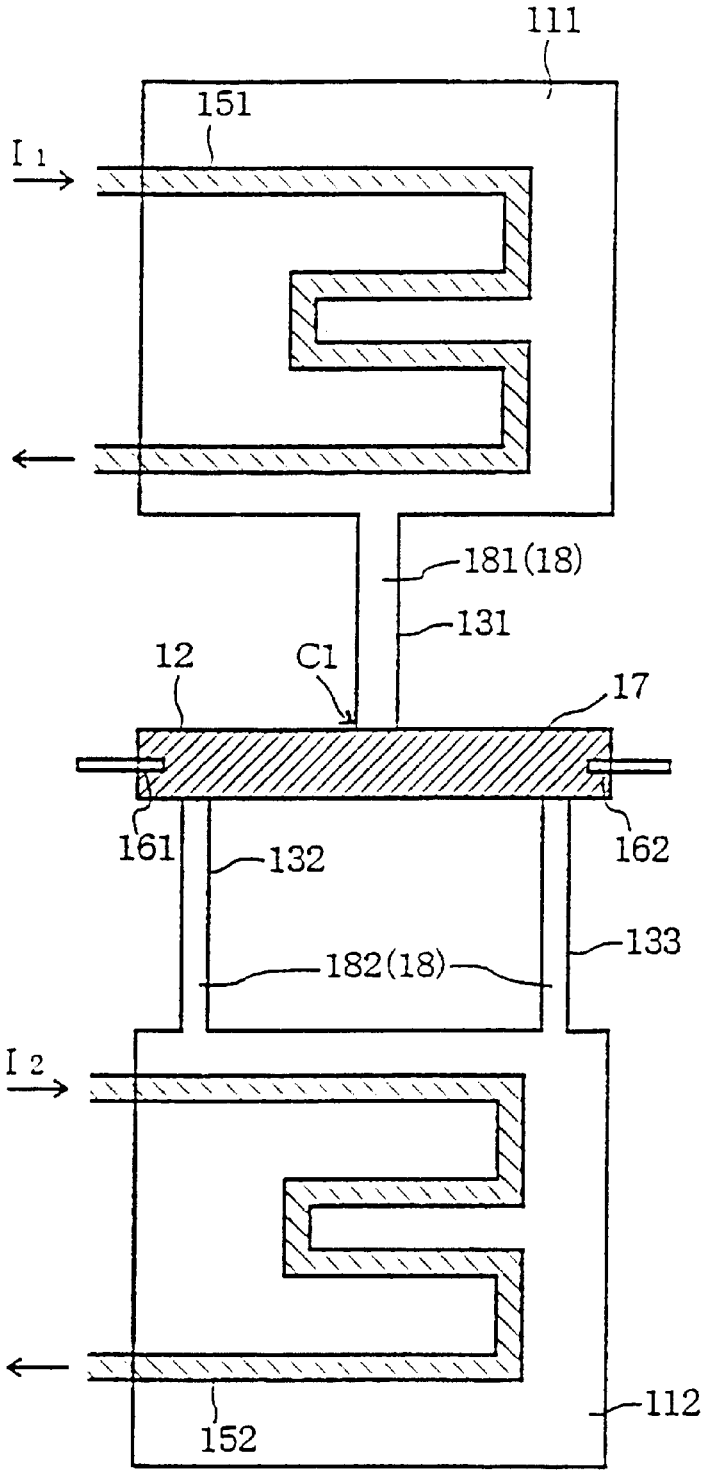
FIG. 1 is a diagram of a conventional microrelay.
Figure 2:
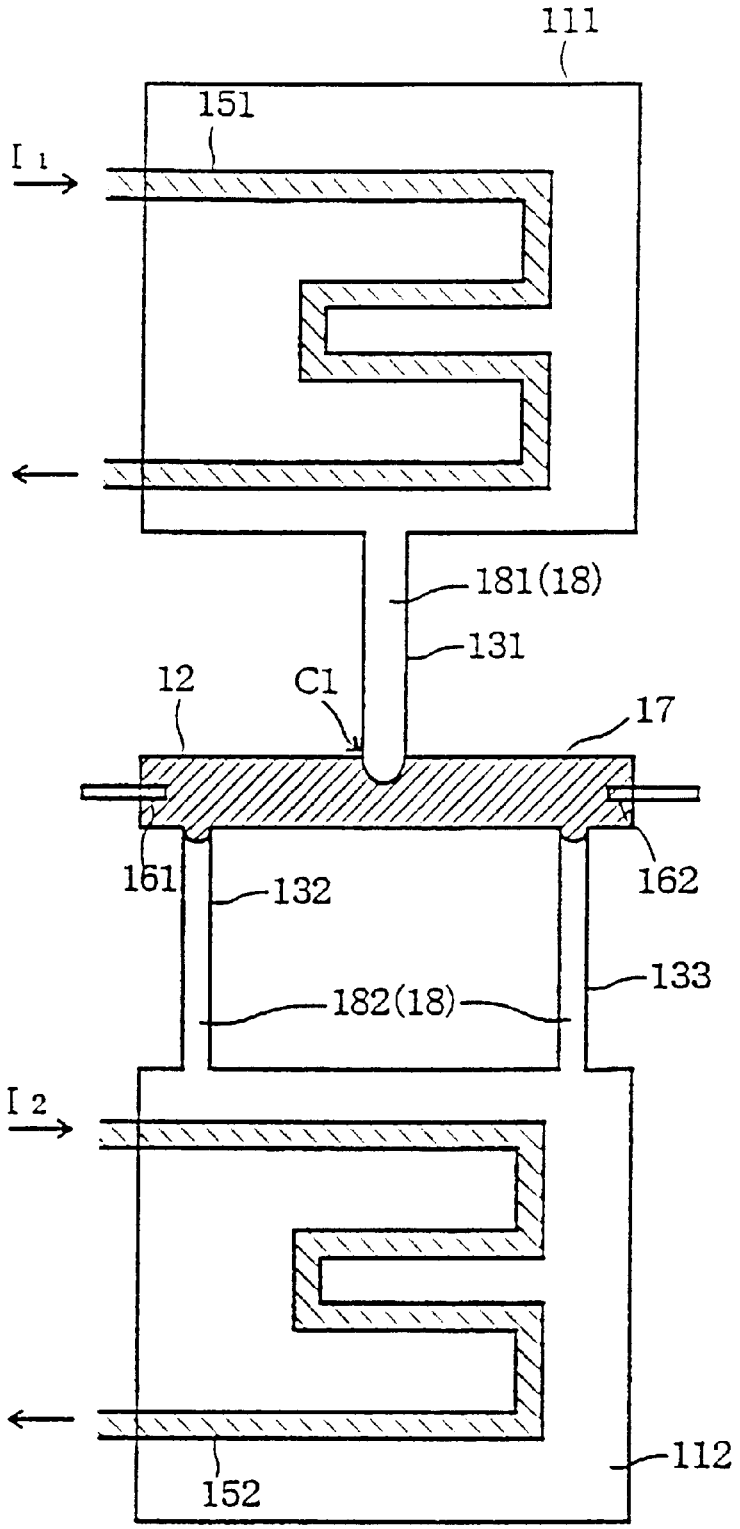
FIG. 2 is a plan view of the electrode components in a "closed" state in the first working example of the present invention.
Figure 3:
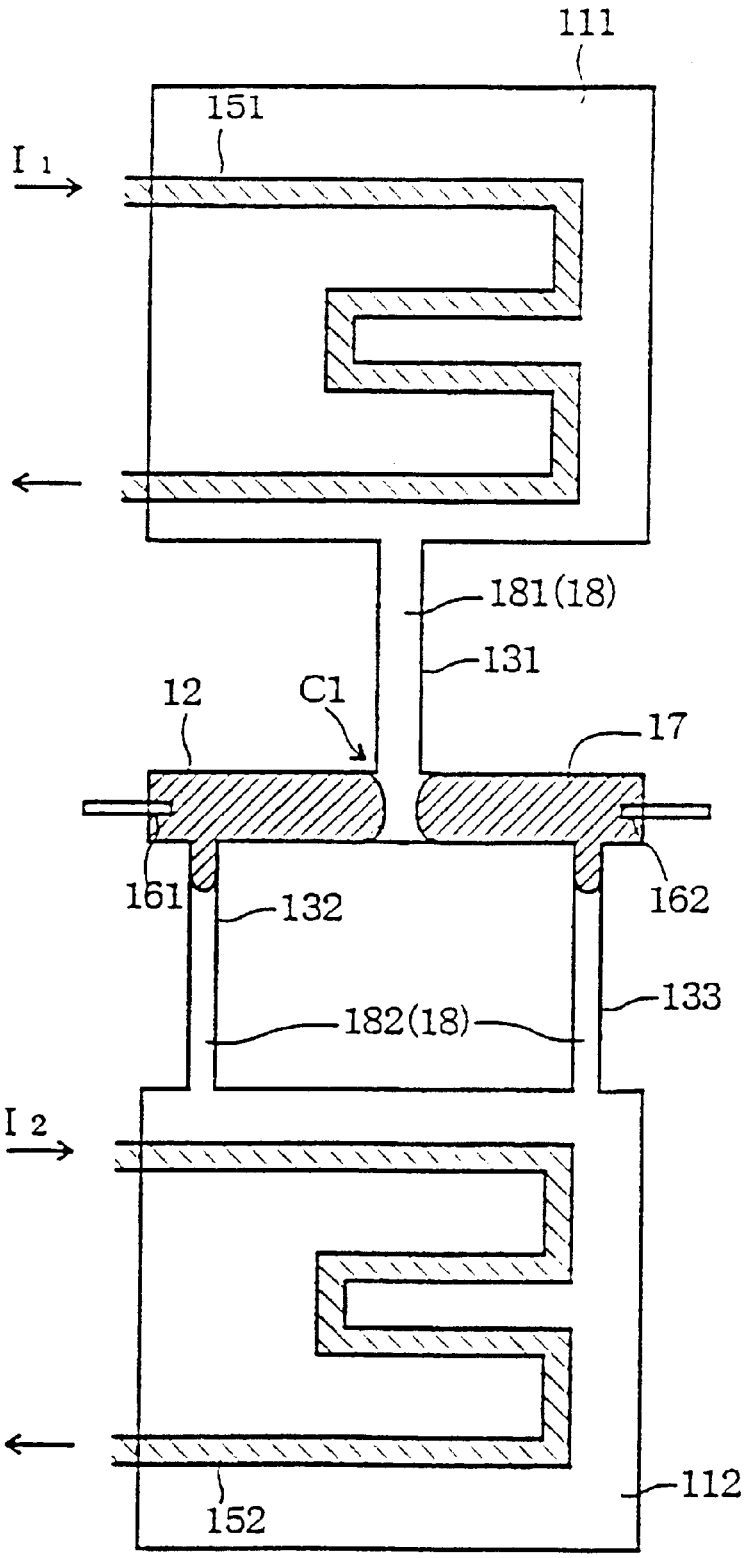
FIG. 3 is a plan view of the electrode components in a "semi-open" state in the first working example of the present invention.
Figure 4:
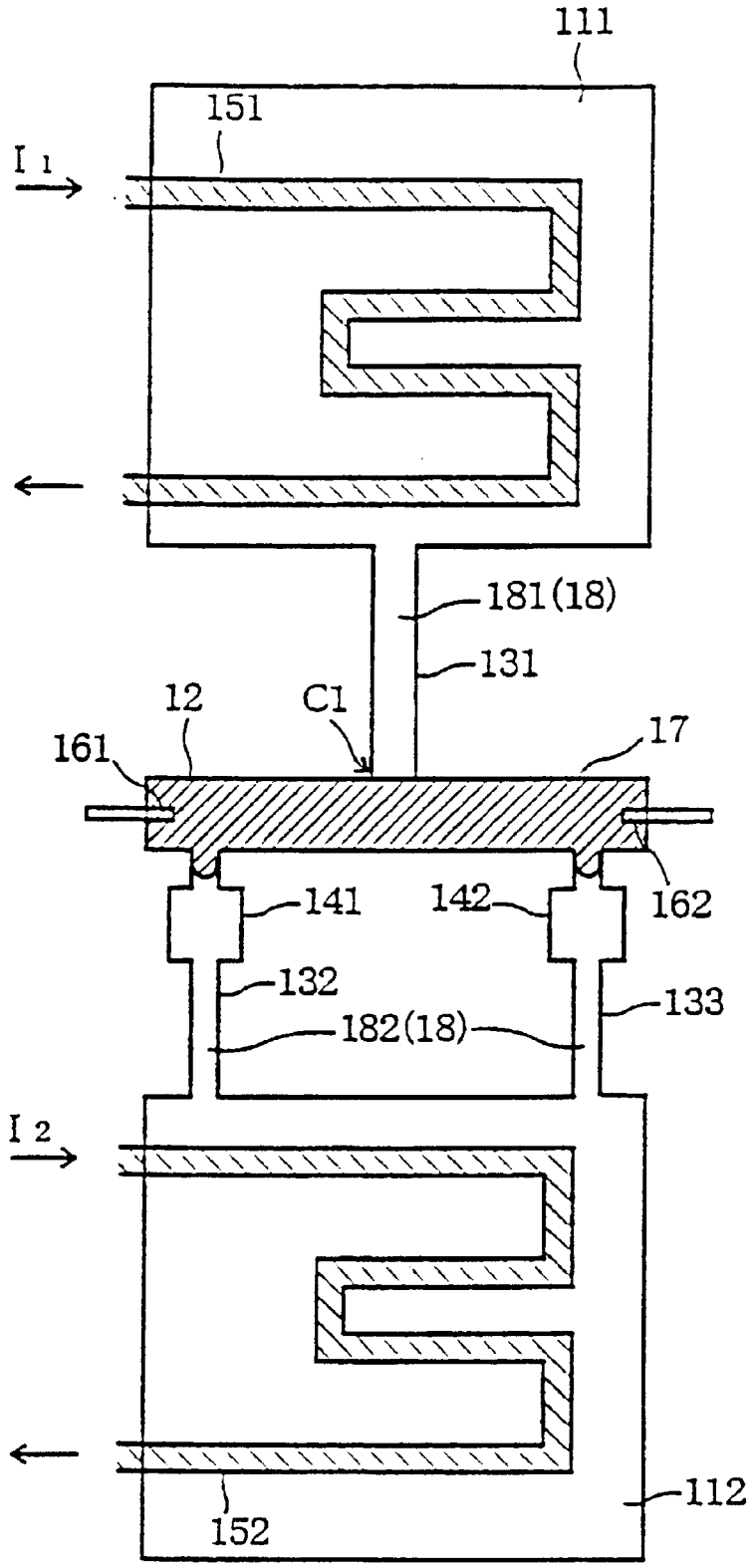
FIG. 4 is a plan view of the electrode components in an "open" state in the first working example of the present invention.

FIGS. 2 to 4 are simplified structural diagrams of a first working example of a device consistent with the present invention. As shown in these figures, an electrical contact breaker switch 100 has a first chamber 111, a second chamber 112, a channel 12 for supplying the conductive fluid, and channels 131, 132, and 133 for supplying the non-conductive fluid. These elements collectively constitute the cavity (or cavities) of the switch 100.

The first chamber 111 and the second chamber 112 are disposed apart from one another, and each preferably has a rectangular shape. The chambers 11 and 112 house heaters 151 and 152, respectively. The channel 131 extends from the side of the first chamber 111 that faces the second chamber 112 toward the second chamber 112. The two channels 132 and 133 extend from the side of the second chamber 112 that faces the first chamber 11 I toward the first chamber 111. In this working example, the length of the channel 12 may be slightly greater than the distance between the channels 132 and 133, and the width of channel 12 may be twice that of the channels 131, 132, and 133. Channel 131 and channels 132 and 133 may have different widths. The channel 12 is formed between the first chamber 111 and the second chamber 112 and is perpendicular to the channels 131, 132, and 133. Electrode components 161 and 162 are formed at respective ends of the channel 12 and have a portion exposed inside the channel 12. The first and second chambers 111 and 112, the heaters 151 and 152, and the channels 131, 132, and 133 are part of the form modification unit in the device consistent with the present invention.

In this working example, gallium may be used as a conductive fluid 17, and nitrogen gas may be used as a non-conductive fluid 18. A non-conductive solid may be used to modify the form of the conductive fluid 17 instead of the non-conductive fluid 18. The conductive fluid 17 is placed into the channel 12 in an amount equal to or somewhat larger than the volume of the channel 12. The non-conductive fluid 18 fills the first and second chambers 111 and 112 and the channels 131, 132, and 133. In FIGS. 2 to 4, the non-conductive fluid 18 on the first chamber 111 side is labeled 181, and the non-conductive fluid 18 on the second chamber 112 side is labeled 182.

In this working example, the size and shape of the cross sections of the channels are designed and the nitrogen gas pressure during heating by the heaters 151 and 152 is determined such that the surface tension of conductive fluid 17 will prevent a large amount of the conductive fluid 17 from flowing from the channel 12 into the channels 131, 132, and 133. The surface tension of the conductive fluid 17 is affected by the wettability of the substances with which the conductive fluid 17 comes into contact. Increasing the wettability lowers the surface tension, whereas lowering the wettability increases the surface tension. Therefore, a large amount of the conductive fluid 17 can be kept from flowing from the channel 12 into the channels 131, 132, and 133 by forming the walls of the channels 131, 132, and 133 from a material or materials having a low wettability with the conductive fluid 17.

The operation of the contact breaker switch of this working example will now be described. When the heaters 151 and 152 are OFF, the channel 12 is completely filled with the conductive fluid 17 in contiguous form as shown in FIG. 2, so that a "closed" state is created between the electrode components 161 and 162. When the conductive fluid 17 is in contiguous form, it is touching or connected in an unbroken sequence. Part of the conductive fluid 17 in contiguous form may overflow into the channels 132 and 133.

If a current $I_1$ is sent to the heater 151 to heat the heater 151, the internal pressure of the first chamber 111 will rise, and the non-conductive fluid 18 will exert pressure on the conductive fluid 17 at the portion adjacent to intersection C1 between the channel 12 and the channel 131. As this pressure increases, as shown in FIG. 3, part of the conductive fluid 17 is replaced by the non-conductive fluid 181 at the intersection C1. This replacement constricts the conductive fluid 17 at the intersection C1. As a result, the conductive fluid 17 is modified from a contiguous form into a semi-contiguous form, and a "semi-open" state is created between the electrode components 161 and 162. Specifically, the conductivity decreases between the electrode components 161 and 162. By adjusting the current $I_1$, it is also possible to vary the extent of the "semi-open" state and stabilize the conductivity between the electrode components 161 and 162 at a suitable value. The "semi-open" state can also be controlled by allowing current 12 to flow to the heater 152 to heat the heater 152.

As shown in FIG. 4, if the current $I_1$ continues to flow during the "semi-open" state in FIG. 3, the non-conductive fluid 181 will completely replace the conductive fluid 17 at the intersection C1, and split the conductive fluid 17 in two into an electrode component 161 side and an electrode component 162 side. The continued flow of current $I_1$ modifies the conductive fluid 17 from the semi-contiguous form of FIG. 3 into a non-contiguous form. In the non-contiguous form, the two components of the conductive fluid 17 do not touch or connect, as shown in FIG. 4. As a result, an "open" state is created between the electrode components 161 and 162.

If the current to the heater 151 is halted in the "open" state, the internal pressure of the first chamber 111 decreases, and the conductive fluid 17 in non-contiguous form that had been divided at the intersection C1 returns to a contiguous form via a semi-contiguous form. Specifically, when the current to the heater 151 is halted, the state between the electrode components 161 and 162 goes from an "open" state to a "semi-open" state and gradually returns to a "closed" state. The conductive fluid 17 can be quickly modified from a non-contiguous form into a contiguous form (that is, the state between the electrode components 161 and 162 can be quickly changed from an "open" state to a "closed" state) by sending current $I_2$ to the heater 152 to rapidly raise the pressure inside the second chamber 112.

In FIGS. 2 to 4, the electrode components 161 and 162 are continuously immersed in the conductive fluid 17. As a result, the contact surfaces of the electrode components 161 and 162 are not roughened and are not subject to corrosion or the like by components of the non-conductive fluid 18. In this working example, the channel 131 containing the non-conductive fluid 18 was disposed at right angles to the channel 12 containing the conductive fluid 17. The non-conductive fluid 18 "squeezed" the columnar conductive fluid 17 in its middle, which is what made the "semi-open" state possible.

Figure 5:
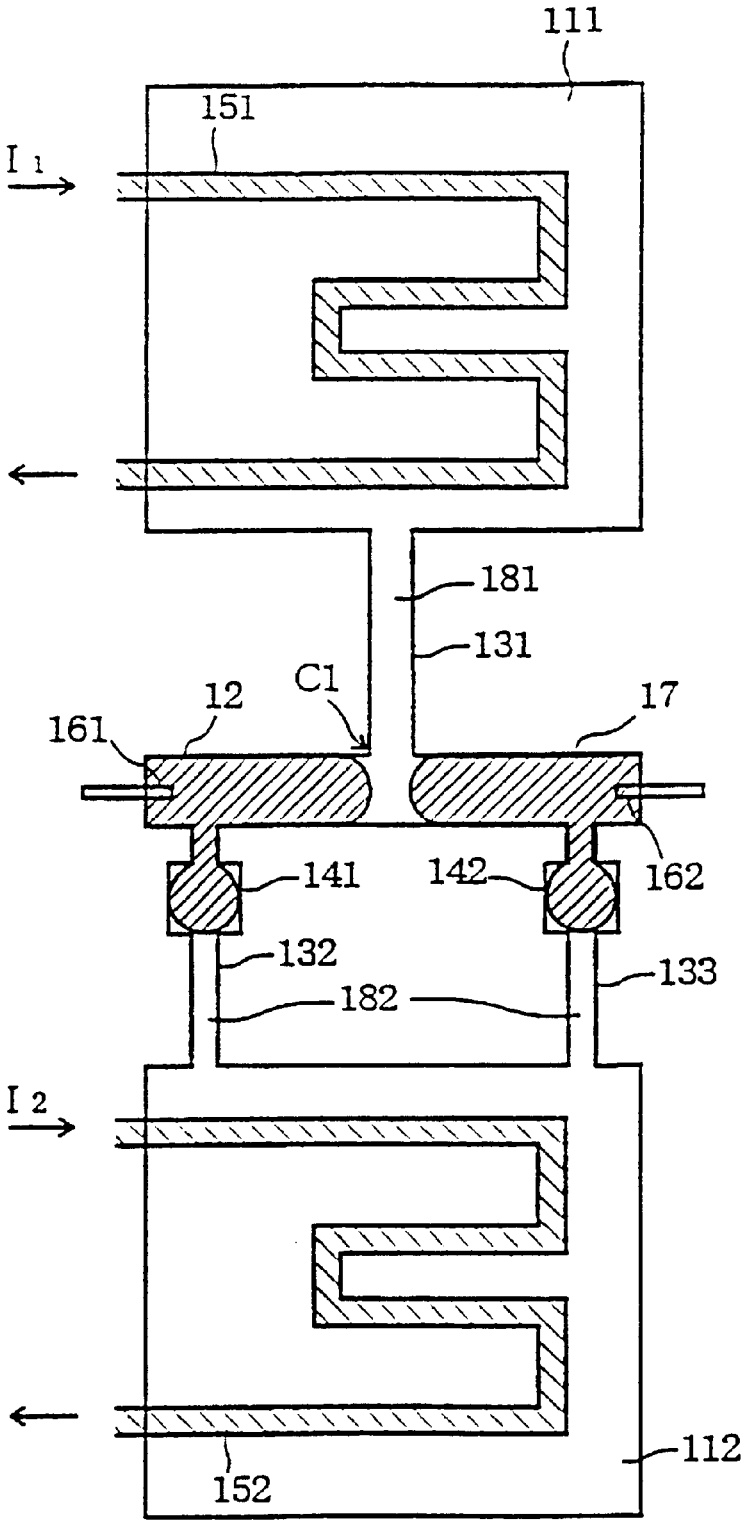
FIG. 5 is a plan view of the electrode components in a "closed" state in a variation on the first working example of the present invention.
Figure 6:
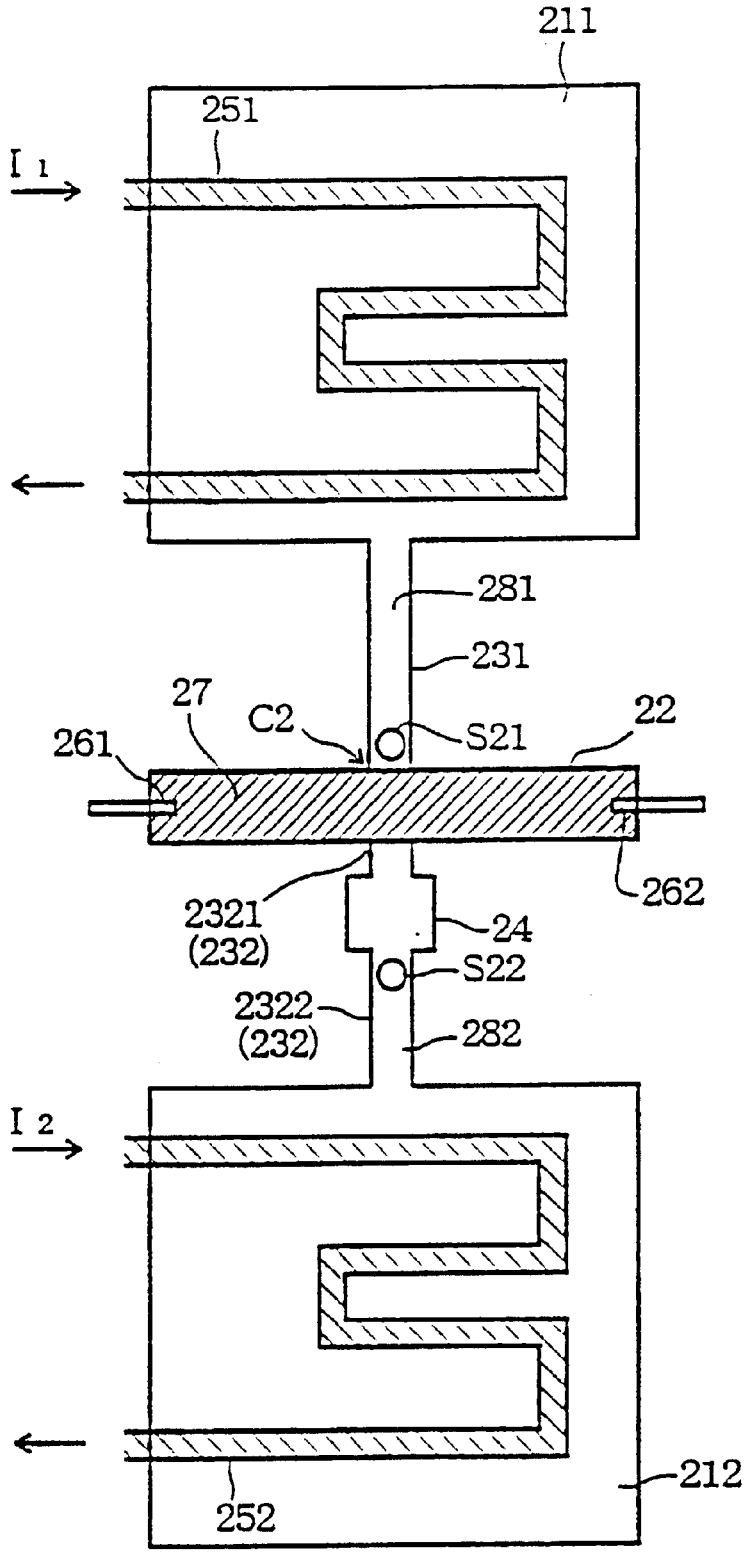
FIG. 6 is a plan view of the electrode components in an "open" state in a variation on the first working example of the present invention.

FIGS. 5 and 6 are simplified structural diagrams illustrating a variation on the first working example. In this variation example, conductive fluid reservoirs 141 and 142, which may be square in plane view and have sides equal in length to the width of the channel 12, are provided in the channels 132 and 133 adjacent the channel 12. The amount or volume of the conductive fluid 17 is preferably somewhat greater than the volume of the channel 12 and less than the sum of the volume of the channel 12, the volume of the two conductive fluid reservoirs 141 and 142, the volume of the channel 132 between the channel 12 and the conductive fluid reservoir 141, and the volume of the channel 133 between the channel 12 and the conductive fluid reservoir 142. When no current is flowing to either of the heaters 151 and 152, the conductive fluid 17 is in a contiguous form, as shown in FIG. 5. If the pressure inside the chamber 111 is then raised by causing the current $I_1$ to flow to the heater 151, the conductive fluid 17 will flow into the conductive fluid reservoirs 141 and 142, as shown in FIG. 6, and the open state is created.

Once in this state, the current to the heater 151 is halted. In a steady state, the pressure inside the chamber 111 is lower than the pressure inside the chamber 112 by the amount that the conductive fluid 17 has moved into the conductive fluid reservoirs 141 and 142. In this variation example, however, since the volume of the chambers 111 and 112 is sufficiently larger than the volume of the conductive fluid reservoirs 141 and 142, the internal pressure differential between the chamber 111 and the chamber 112 is very slight. Forces such as the viscosity of the conductive fluid 17 and the surface tension of the conductive fluid 17 inside the conductive fluid reservoirs 141 and 142 overcome the internal pressure differential, so that the conductive fluid 17 is stable in the state shown in FIG. 6.

The state between the electrode components 161 and 162 can be changed from the "open" state of FIG. 6 to the "closed" state of FIG. 5 by sending the current $I_2$ to the heater 152 to heat the heater 152. Heating the heater 152 raises the internal pressure of the chamber 112 by a specific amount over the internal pressure of the chamber 111.

Figure 7:
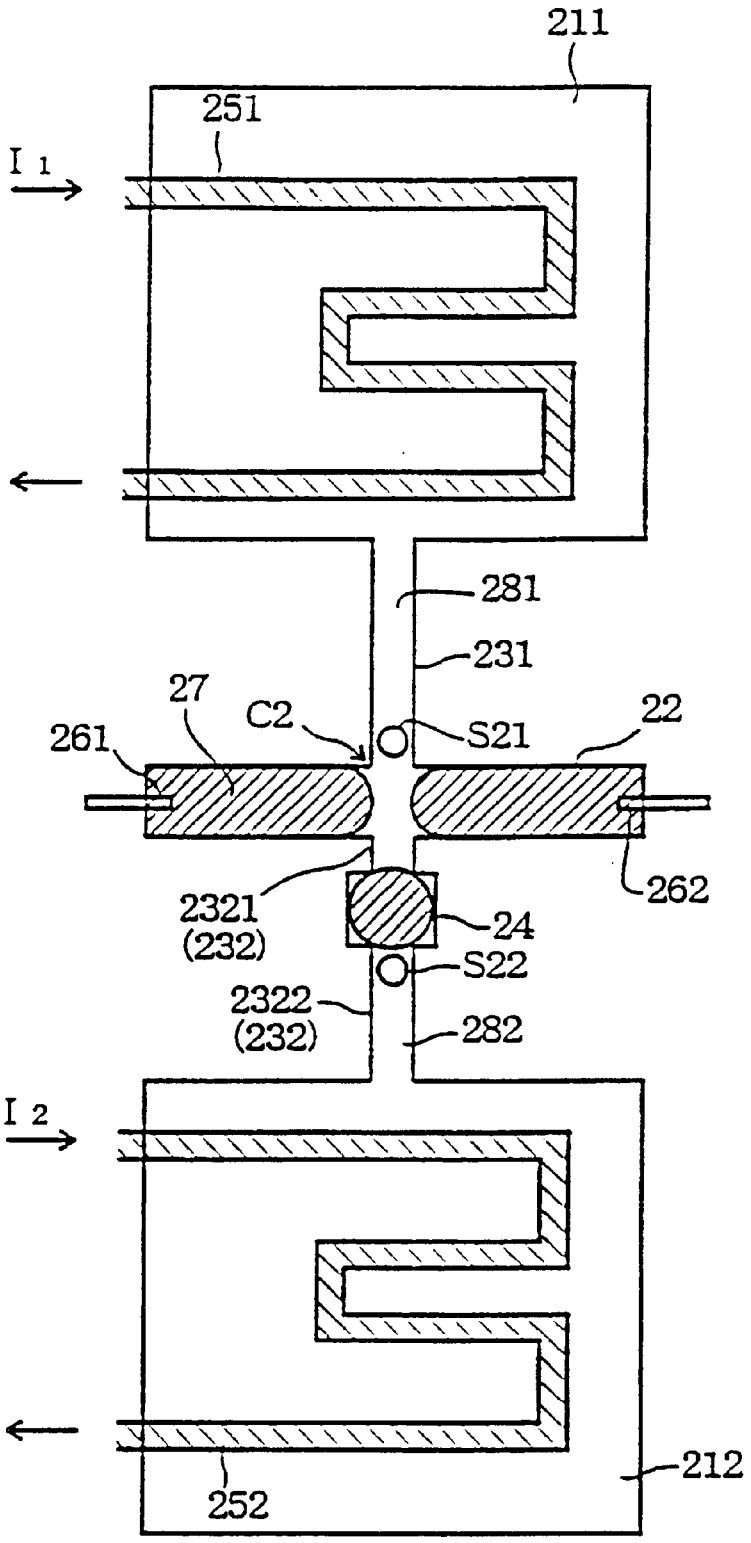
FIG. 7 is a plan view of the electrode components in a "closed" state in the second working example of the present invention.
Figure 8:
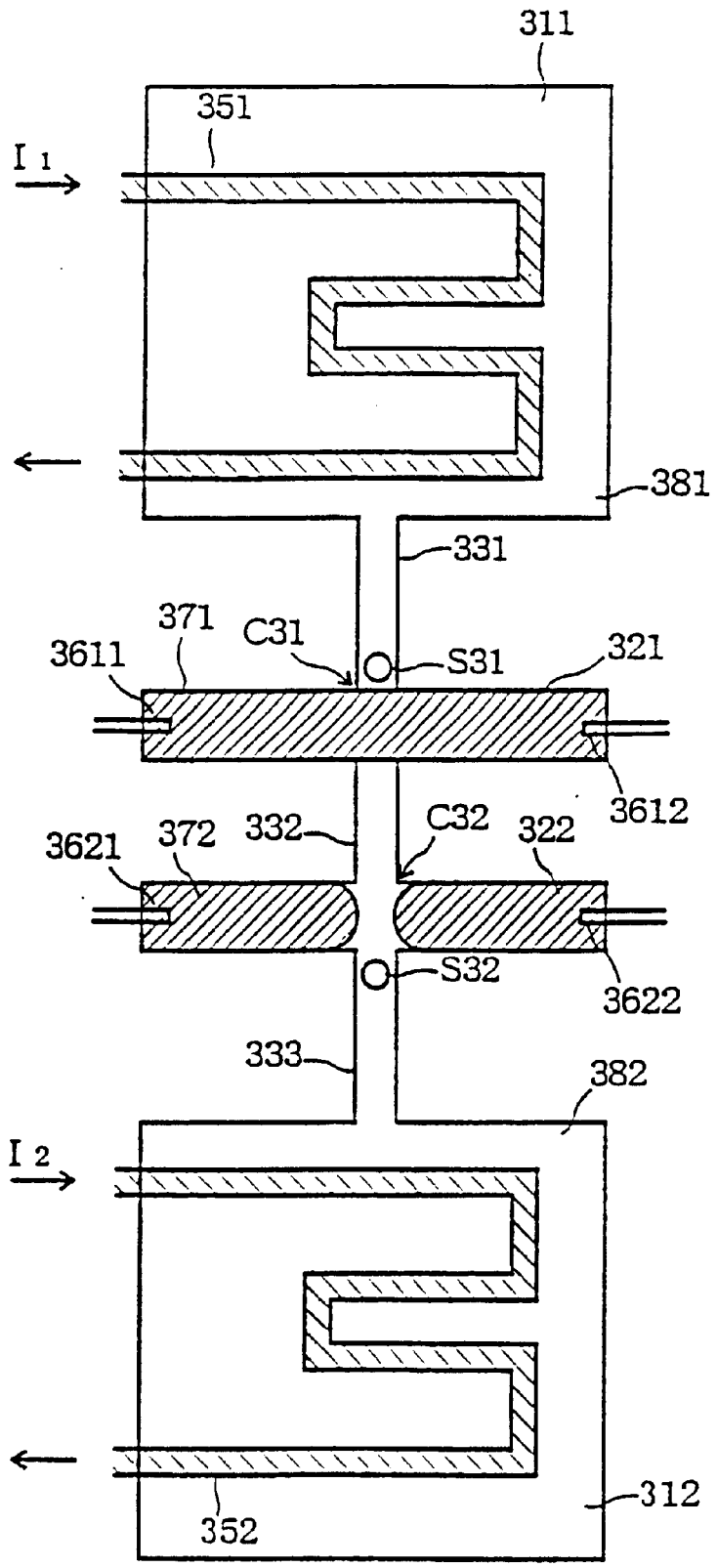
FIG. 8 is a plan view of the electrode components in an "open" state in the second working example of the present invention.

FIGS. 7 and 8 are simplified structural diagrams illustrating a second working example of the device consistent with the present invention. As shown in FIGS. 7 and 8, an electrical contact breaker switch 200 has a first chamber 211, a second chamber 212, a channel 22 for supplying the conductive fluid, and channels 231 and 232 for supplying the non-conductive fluid. These elements collectively constitute the cavity (or cavities) in the switch 200. The structure of the first and second chambers 211 and 212 and the structure of heaters 251 and 252 provided inside these respective chambers are the same as those of the first and second chambers and their heaters in the first working example. As in the first working example, the conductive fluid 27 and the non-conductive fluid 28 may be gallium and nitrogen gas, respectively.

The channel 231 extends from the side of the first chamber 211 that faces the second chamber 212 toward the second chamber 212. The channel 232 extends from the side of the second chamber 212 that faces the first chamber 211 toward the first chamber 211 and is coaxial with the channel 231. The channel 22 is formed between the first chamber 211 and the second chamber 212 and is perpendicular to the channels 231 and 232. Specifically, a linear channel consisting of the channels 231 and 232 is disposed in the shape of a cross with the channel 22. Again in this working example, electrode components 261 and 262 are formed at both ends of the channel 22 for supplying the conductive fluid and have a portion exposed inside the channel 22.

In FIGS. 7 and 8, the width of the channel 22 may be twice that of the channels 231 and 232. A stopper S21, such as a pin, is formed in the portion of the channel 231 near its intersection C2 with the channel 22, and a conductive fluid reservoir 24 is formed in the portion of the channel 232 near its intersection C2 with the channel 22. A stopper S22, such as a pin, is formed in the portion 2321 of channel 232 between reservoir 24 and chamber 212. In FIGS. 7 and 8, 2321 is the portion of the channel 232 between its intersection C2 and the conductive fluid reservoir 24, and 2322 is the portion of the channel 232 between the conductive fluid reservoir 24 and the second chamber 212.

Instead of or in addition to the stopper S21, the cross sectional area of the channel 231 adjacent the first chamber 211 can be made smaller. Similarly, the cross sectional area of the channel portion 2322 can be made smaller instead of or in addition to the stopper S22. The amount of the conductive fluid 27 may be somewhat greater than the volume of the channel 22, including the intersection C2. The conductive fluid 27 may move in the region composed of the channel 22, the conductive fluid reservoir 24, and the channel 2321. In FIGS. 7 and 8, 281 is the non-conductive fluid 28 on the first chamber 211 side, while 282 is the non-conductive fluid 28 on the second chamber 212 side.

The operation of the contact switch of this working example will now be described. As shown in FIG. 7, when the heaters 251 and 252 are OFF, the channel 22 is completely filled with the conductive fluid 27 in contiguous form, which creates a "closed" state between the electrode components 261 and 262. In FIG. 7, part of the conductive fluid 27 in contiguous form may extend into the channel 232 as far as the stopper S21.

At this point, if current $I_1$ is sent to the heater 251 to heat the heater 251, the internal pressure of the chamber 211 will rise, and the non-conductive fluid 281 will apply pressure on the portion of the conductive fluid 27 adjacent to intersection C2. This pressure pushes the conductive fluid 27 in the intersection C2 portion into the channel 232 and into the conductive fluid reservoir 24. The conductive fluid 27 in channel 22 is thereby split in two, part located in the electrode component 261 side of the channel 22 and part located in the electrode component 262 side of the channel 22. This split modifies the conductive fluid 27 from the contiguous form of FIG. 7 into the non-contiguous form of FIG. 8. As a result, an "open" state is created between the electrode components 261 and 262. In this state, the current to the heater 251 is halted. In a steady state, the pressure inside the chamber 211 is lower than the pressure inside the chamber 212 by an amount corresponding to the amount of the conductive fluid 27 that has moved into the conductive fluid reservoir 24. In this working example, however, since the volume of the chambers 211 and 212 is sufficiently larger than the volume of the conductive fluid reservoir 24, the internal pressure differential between the chamber 211 and the chamber 212 is small. Forces, such as the viscosity of the conductive fluid 27 and the surface tension of the-conductive fluid 27 inside the conductive fluid reservoir 24, overcome the internal pressure differential so that the state of the conductive fluid 27 shown in FIG. 8 is stable.

The conduction state between the electrode components 261 and 262 can be changed from the "open" state of FIG. 8 to the "closed" state of FIG. 7 by sending the current $I_2$ to the heater 252 to heat the heater 252. The heating by the heater 252 raises the internal pressure of the chamber 212 by a specific amount over the internal pressure of the chamber 211.

With the device in this working example, just one channel connects each of the first and second chambers 211 and 212 to the channel 22. Therefore, the device in this working example can be made more compact than the device in the first working example. Also, since the channel 22 is closed near both of its ends, there is no danger of the conductive fluid 27 leaking from the channel 22, even in the event of a considerable impact.

Figure 9:
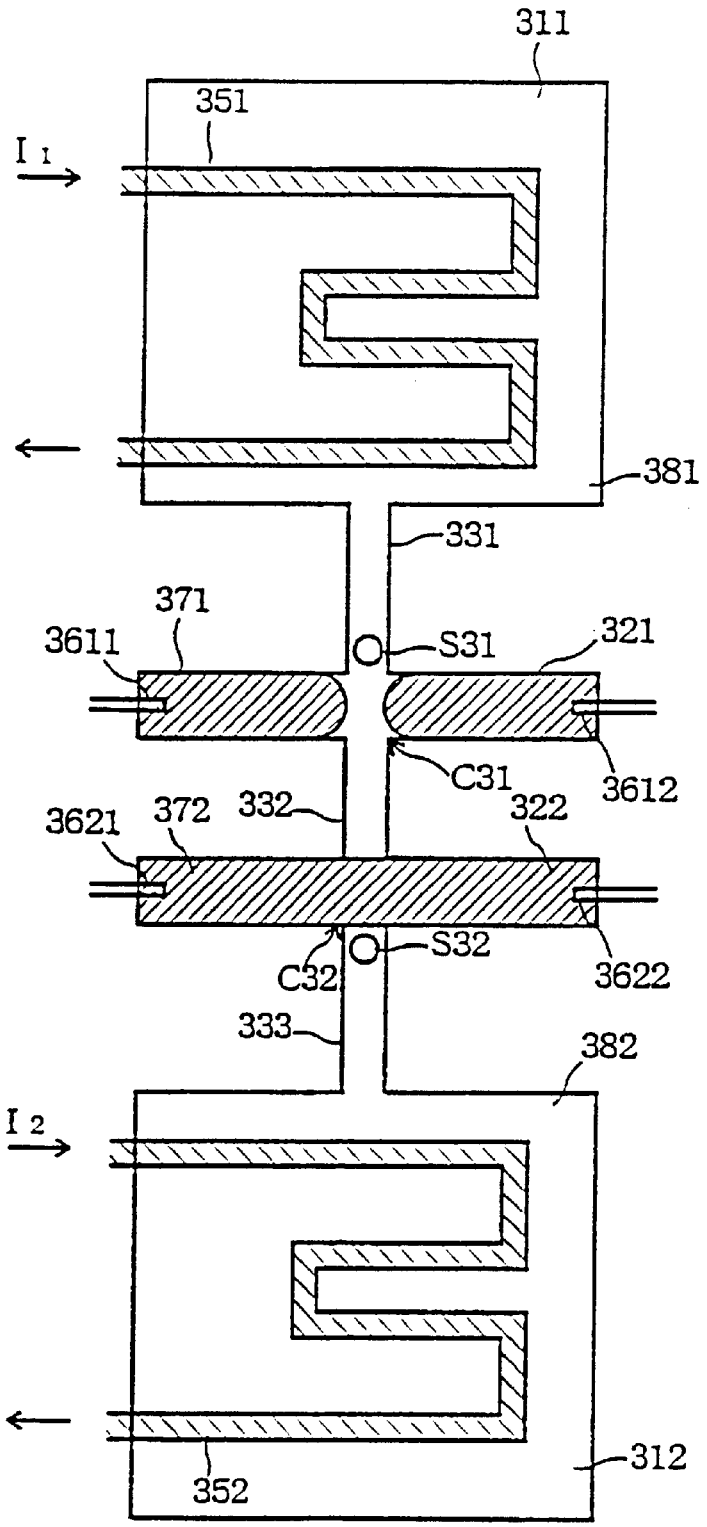
FIG. 9 is a plan view of the electrode components in a "closed" state in the third working example of the present invention.
Figure 10:
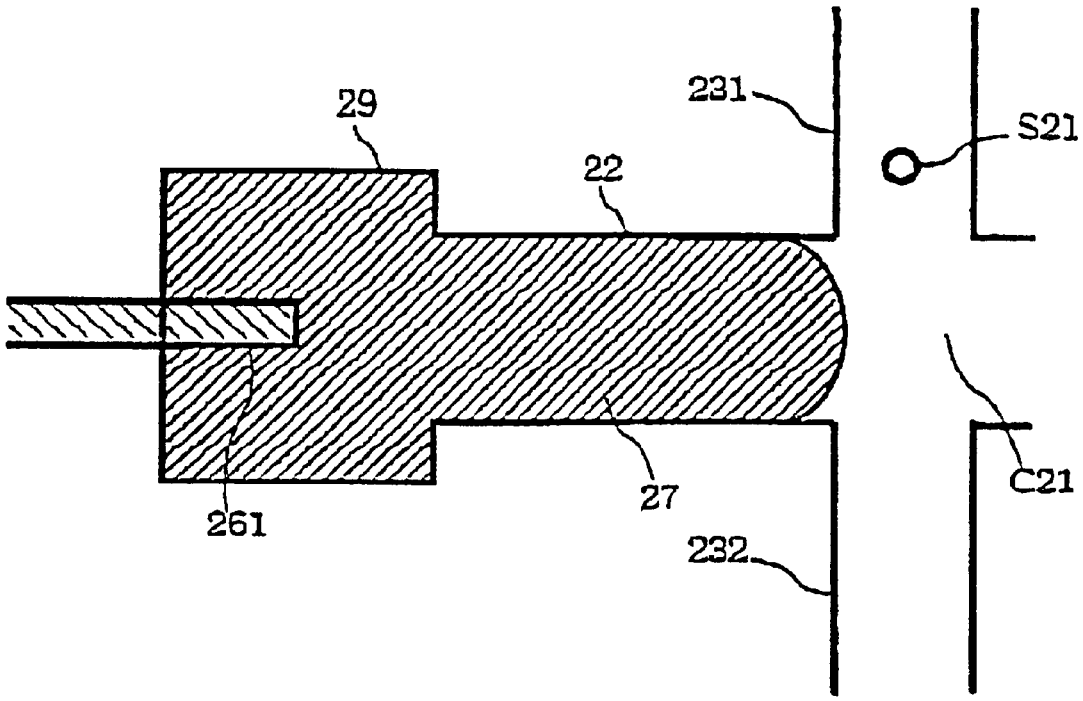
FIG. 10 is a plan view of the electrode components in an "open" state in the third working example of the present invention.

FIGS. 9 and 10 are simplified structural diagrams illustrating a third working example of the device consistent with the present invention. As shown in FIGS. 9 and 10, an electrical contact breaker switch 300 has a first chamber 311, a second chamber 312, channels 321 and 322 for supplying the conductive fluid, and channels 331, 332, and 333 for supplying the non-conductive fluid. These elements collectively constitute the cavity (or cavities) of the switch 300. The structure of the first and second chambers 311 and 312 and the structure of heaters 351 and 352 provided inside these respective chambers are the same as those of the first and second chambers and their heaters in the first and second working examples. Also, as in the first and second working examples, the conductive fluid and non-conductive fluid that are placed into the cavity may be gallium and nitrogen gas, respectively.

The channels 331, 332, and 333 are preferably formed in a straight line between the first chamber 311 and the second chamber 312 and perpendicular to the side of the first chamber 311 facing the second chamber 312 or the side of the second chamber 312 facing the first chamber 311. The channel 321 is formed perpendicular to and at the boundaries of the channels 331 and 332, and a channel 322 is formed perpendicular to and at the boundaries of the channels 332 and 333. With this working example, there are provided two channels corresponding to the channel 22 in the second working example. Electrode components 3611 and 3612 are formed at opposite ends of the channel 321 and have a portion exposed inside the channel 321. Electrode components 3621 and 3622 are formed at opposite ends of the channel 322 and have a portion exposed inside the channel 322.

In FIGS. 9 and 10, the width of the channels 321 and 322 may be twice that of the channels 331 to 333. A stopper S31, such as a pin, is formed in the portion of the channel 331 near its intersection C31 with the channel 321, and a stopper S32, such as a pin, is formed in, the portion of the channel 333 near its intersection C32 with the channel 322. Alternatively, instead of or in addition to the stoppers S31 and S32, the cross sectional area of the channel 331 or the cross sectional area of the channel 333 side can be reduced.

The amount of the conductive fluid 37 may be somewhat less than the sum of the volumes of the channels 321 and 322, including the intersections C31 and C32. The conductive fluid 37 is placed into the channels 321 and 322. In FIGS. 9 and 10, 381 is the non-conductive fluid 38 on the first chamber 311 side, while 382 is the nonconductive fluid 38 on the second chamber 312 side.

The operation of the contact switch of this working example will now be described. As shown in FIG. 9, when the heaters 351 and 352 are in a non-operating state, the channel 321 is filled with the conductive fluid 371 in contiguous form, and all of the channel 322, except for the intersection C32, is filled with the conductive fluid 372 in non-contiguous form. As a result, a "closed" state is created between the electrode components 3611 and 3612, and an "open" state is created between the electrode components 3621 and 3622.

If current $I_1$ is sent to the heater 351 to heat the heater 351, the internal pressure of the chamber 311 will rise, and the non-conductive fluid 381 will press on the conductive fluid 371 at the portion adjacent to intersection C31. As a result of this pressure, the conductive fluid 371 adjacent to the intersection C31 portion is pushed through the channel 332 into the intersection C32. The conductive fluid 371 in the channel 22 is thereby split in two, part located in the electrode component 3611 side of the channel 22 and part located in the electrode component 3612 side of channel 22. This splitting modifies the conductive fluid 371 from the contiguous form of FIG. 9 into the non-contiguous form of FIG. 10.

Meanwhile, the conductive fluid that was originally at the intersection C31 portion of the conductive fluid 371 flows through channel 332 to merge with the conductive fluid 372. The stopper S32 prevents this fluid from flowing into channel 333. The conductive fluid 372 is modified from the non-contiguous form of FIG. 9 into the contiguous form of FIG. 10. As a result, an "open" state is created between the electrode components 3611 and 3612, and a "closed" state is created between then electrode components 3621 and 3622. Once in this state, the current to the heater 351 is halted. In a steady state, the pressure inside the chamber 311 is lower than the pressure inside the chamber 312 by an amount corresponding to the part of the conductive fluid 371 that moved into channel 322. In this working example, however, since the volume of the chambers 311 and 312 is sufficiently larger than the volume of the channel 332, the internal pressure differential between the chambers 311 and 312 is very slight. Forces, such as the viscosity of the conductive fluid and the surface tension of the conductive fluid, overcome the internal pressure differential so that the conductive fluids 371 and 372 are stable in the state shown in FIG. 10.

The state between the electrode components 3611 and 3612 can be changed from the "open" state of FIG. 10 to the "closed" state of FIG. 9, and the state between the electrode components 3621 and 3622 can be changed from the "closed" state of FIG. 10 to the "open" state of FIG. 9 by sending the current $I_2$ to the heater 352 to heat the heater 352. The heating of the heater 352 raises the internal pressure of the chamber 312 by a specific amount over the internal pressure of the chamber 311.

Figure 11:
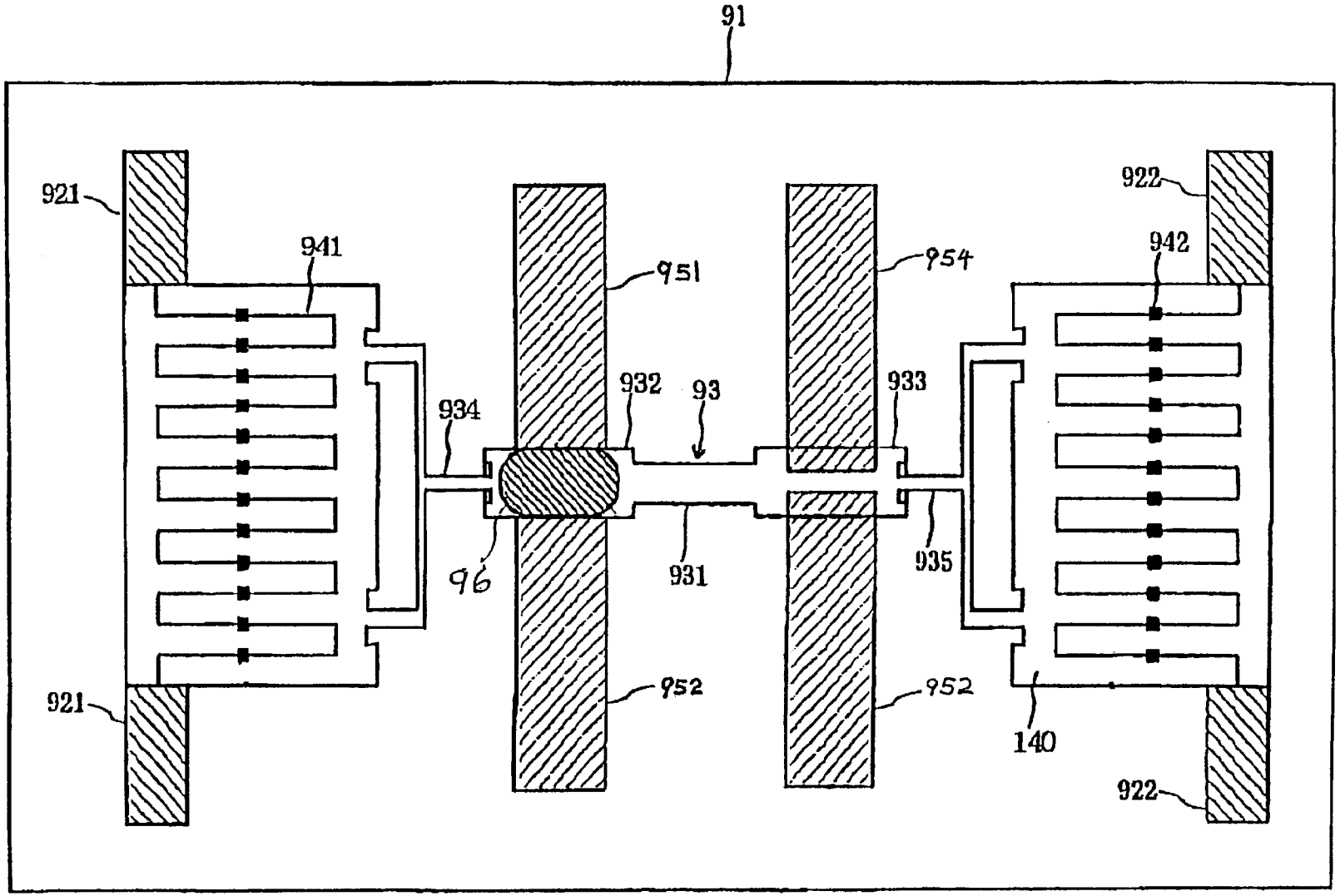
FIG. 11 is a plan view of when a conductive fluid reservoir was formed in the channel for supplying the conductive fluid in the second working example of the present invention.

Conductive fluid reservoirs can be formed in the vicinity of the electrode components 261 and 262 at both ends of the channel 22 in the second working example discussed above with reference to FIG. 7, and in the vicinity of the electrode components 3611, 3612, 3621, and 3622 at the respective ends of the channels 321 and 322 in the third working example. The formation of conductive fluid reservoirs is effective if there is a concern that the conductive fluid may flow out of the channels. FIG. 11 is a diagram illustrating the conductive fluid reservoir 29 formed in the channel 22 adjacent to the electrode component 261 in the second working example. The conductive fluid reservoir 29 keeps the conductive fluid 27 in the channel 22.

The process of manufacturing the device consistent with the present invention will now be described. A method for manufacturing a contact breaker switch by laminating a silicon substrate with a glass substrate will also be described. In addition to this method, the device consistent with the present invention can be manufactured by other methods, such as combining silicon substrates or other semiconductor substrates, or combining glass substrates.

The manufacture of the electrical contact breaker switch illustrated in FIGS. 7 and 8 will be used as an example below. This example describes (1) the step of forming the electrode components 261 and 262 and the heaters 251 and 252, (2) the step of forming grooves corresponding to the cavity, including the two chambers 211 and 212, the channels 22, 231, and 232, and the conductive fluid reservoir 24, in the silicon substrate and/or the glass substrate, (3) the step of introducing the conductive fluid 27, (4) the step of introducing the non-conductive fluid 28 and laminating the silicon substrate with the glass substrate, and (5) the step of dicing.

Using a four-inch wafer as the silicon substrate, the electrode components 261 and 262 (solid electrodes) and the heaters 251 and 252 are formed by a combination of conductive and insulating layers. An aluminum thin film produced by sputtering may be used as the conductive layer, and silicon oxide produced by CVD may be used as the insulating layer. This method for forming a circuit is a known semiconductor process. With this method, various active circuits, such as a heater drive circuit that makes use of transistors or the like, or passive circuit elements, such as resistors, can be formed on the silicon substrate along with the formation of the electrode components 261 and 262 and the heaters 251 and 252.

When aluminum is used to form the electrode components 261 and 262 that come into contact with the conductive fluid, such as gallium, the aluminum surface may be prone to corrosion through reaction with the conductive fluid, which may compromise the long-term reliability of the device. It is therefore preferable for a layer composed of a material that does not react with gallium, such as tungsten or molybdenum, to be used to form these electrode components, and more specifically, the portions of the solid electrodes exposed in the channel holding the conductive fluid. With this manufacturing example, the electrode components 261 and 262 may be formed by first forming a titanium film as an adhesive layer on the portions of the solid electrodes exposed in the channel, and then forming a tungsten film as a contact layer over this titanium film.

Preferably, the surface area of the portions of the electrode components 261 and 262 that contact the conductive fluid are increased to obtain a lower viscosity. In the second working example (FIGS. 7 and 8), the electrode components 261 and 262 were only shown as being provided in the vicinity of the ends of the channel 22 for the sake of simplifying the description. It is preferable, however, for the electrode components 261 and 262 to extend from the ends of the channel to the vicinity of the intersection C2. Also, in the second working example, the electrode components 261 and 262 were shown in a shape that protruded into the channel 22. The electrode components 261 and 262 can instead be formed in a planar shape on the inside walls of the channel 22 in order to increase the contact surface area between the electrode components 261 and 262 and the conductive fluid.

Using tungsten or molybdenum thin films, the heaters 251 and 252 may be formed on the silicon substrate in the same manner as the electrode components 261 and 262. To raise the efficiency with which heat is generated and radiated, the heaters 251 and 252 may be bent a number of times within a square region measuring, for example, 0.4 mm on one side, with a thickness of about 0.3 $\mu$m and a line width of about 0.1 mm. Only two bends are shown in FIGS. 7 and 8 for the sake of simplicity, but the actual number may be ten or more.

It is effective for the substrate beneath the heaters 251 and 252 to be etched away so that the heaters are raised up in relief within the chambers 211 and 212 in order to enhance the heat generation and radiation efficiency. In this manufacturing example, to raise up the heaters in the chambers, everything except the heaters 251 and 252 may be masked with silicon dioxide or silicon nitride. The silicon portion within this masked region may be anisotropically etched with potassium hydroxide to form hollows in the form of inverted pyramids beneath the heaters. It is unnecessary to raise up the heaters 251 and 252 in the chambers 211 and 212 if a material with a low thermal conductivity is used as the substrate on which the heaters are formed.

The grooves corresponding to the cavity constituting the two chambers 211 and 212, the channels 22, 231, and 232, and the conductive fluid reservoir 24 can be formed on either the silicon substrate, the glass substrate, or both. In this manufacturing example, the grooves that serve as the channels 22, 231, and 232 may be formed on the silicon substrate in the course of forming the hollows beneath the heaters by anisotropic etching. The groove width of the channel 22 is preferably 0.2 mm, and the groove width of the channels 231 and 232 is preferably 0.1 mm. The grooves may have a cross sectional shape corresponding to an inverted isosceles triangle. The depth of each groove may be about 0.14 mm when the groove width is 0.2 mm, and about 0.07 mm when the groove width is 0.1 mm.

In this manufacturing example, the cavities used for the chambers 211 and 212 may be formed to face the respective surfaces on the silicon substrate side and the glass substrate side, and the chambers 211 and 212 may be formed by laminating the two substrates. The heaters 251 and 252 can be raised up in relief within the respective chambers 211 and 212 by forming the chamber cavities on both the silicon substrate side and the glass substrate side.

The cavities for the chambers may be square in shape, preferably measuring 0.5 mm on one side. The depth of the cavity formed on the silicon substrate side is preferably 0.1 mm, while the depth of the cavity formed on the glass substrate side is preferably 0.1 mm. If the depth of the cavity formed on the silicon substrate side is different than the depth of the cavity formed on the glass substrate side, the heaters may be susceptible to stress that is produced when the non-conductive fluid goes in and out of the cavities used for the chambers. It is therefore preferable for the depths of the cavities to be the same, as in this working example. The cavity on the silicon substrate side may be formed by KOH anisotropic etching, while the cavity on the glass substrate side may be formed by sandblasting.

The cavity for the conductive fluid reservoir 24 may be formed on the silicon substrate side only. This groove may be square in shape, preferably measuring 0.2 mm on each side, and have a depth of about 0.1 mm. In this manufacturing example, the cavity for the conductive fluid reservoir may be formed at the same time as the groove for the chamber on the silicon substrate side.

In this manufacturing example, the grooves for the channels may be formed on the silicon substrate, but they can also be formed on the glass substrate side. Methods that may be used when the grooves are formed on the glass substrate side include forming a resist pattern on the glass substrate side, chemically etching the glass substrate with aqueous hydrogen fluoride, and mechanically removing the material by sandblasting. With the use of etching, the grooves can be formed to more precise dimensions, and the inner walls of the grooves can be made smoother. On the other hand, the grooves can be formed in a shorter time with sandblasting, although the process leaves rough surfaces where material has been removed.

There may be cases when a rough surface is intentionally formed on the inner walls for a channel filled with the conductive fluid, or a channel through which the conductive fluid moves. These channels, however, are usually formed by etching so that their inner walls will be smoother. Also, in this manufacturing example, the stoppers S21 and S22 may be formed on the glass substrate side by etching.

The step of introducing the conductive fluid 27, such as gallium, into the groove corresponding to the channel 22 may be carried out in a nitrogen atmosphere. When liquid gallium is introduced into the groove corresponding to channel 22, a liquid precision metering discharge apparatus, such as a dispenser, may be used. Alternatively, a metal mask printing method may be used.

A liquid precision metering discharge apparatus puts a liquid into a container, such as a syringe, sends a tiny amount of nitrogen into the syringe, and discharges the liquid out of the syringe. This apparatus is capable of discharging a fluid in amounts as small as $1/100{,}000$ of a cubic centimeter. If combined with a robot, it can install a liquid at a specific location having a width as narrow as 0.1 mm. Among the advantages of this method are that a precise amount of gallium can be introduced, and a single apparatus can accommodate grooves of many different shapes if a robot is used. Using this apparatus, gallium may be introduced in a width of 0.2 mm and a length of about 0.5 mm in the groove corresponding to the channel 22.

With a metal mask printing method, a metal mask having a thickness of preferably 0.2 mm and a hole of about 0.5 mm in length and 0.15 mm in width may be used. The mask is positioned at the groove corresponding to the channel 22 formed in the silicon substrate, and the gallium is printed. In general, it is difficult with this method to print a liquid with low viscosity, such as gallium. With this manufacturing example, however, the grooves have already been formed in the silicon substrate to be printed. As a result, the gallium can be installed easily without running and spreading out. Metal mask printing is somewhat inferior to using a liquid precision metering discharge apparatus in terms of the precision of the amount of gallium installed. Metal mask printing does have an advantage in that it does not require expensive apparatus, so that initial investment costs can be kept low.

When gallium is used as the conductive fluid 27, as in this manufacturing example, installing the conductive fluid in the specific grooves is generally carried out at a temperature of at least 30° C., or, when a liquid precision metering discharge apparatus is used, the gallium inside the syringe is preferably first heated to at least 30° C. When a substance with a lower melting point is used as the conductive fluid, the atmospheric temperature or the temperature of the conductive fluid inside the syringe are determined according to this melting point.

When the gallium is to be installed in the specific grooves in the form of a solid, this installation can be accomplished by punching out a gallium sheet. More specifically, a sheet of gallium is placed over a silicon substrate in which a groove corresponding to the channel 22 (0.2 mm wide and 5.0 mm long) has already been formed. A metal jig, on which is formed a protrusion with the same width and length as the groove, is positioned so that the protrusion is aligned with the groove. The solid gallium is then pushed into the groove. To handle the gallium as a stable solid, the ambient temperature of the gallium is preferably at 30° C. or below. Accordingly, an advantage of this installation method is that the work can be carried out at room temperature.

The step of laminating the silicon substrate with the glass substrate may be carried out in a nitrogen atmosphere. Since the non-conductive fluid 28 is nitrogen gas, the spaces inside the cavities are filled with the non-conductive fluid 28 at the same time as the lamination. The lamination of the substrates can be accomplished by coating the surface of one or both of the silicon substrate and glass substrate with a UV-curing resin, aligning the two substrates, and pressing them together using a precision bonding apparatus. The resulting lamination is then irradiated with UV light. A similar lamination can also be produced by using a thermosetting resin instead of a UV-curing resin.

A silicone resin that acts as a gasket may be applied around the edges of the grooves that serve as the channels 22, 231, and 232 and the grooves that serve as the chambers 211 and 212. This resin is cured, and the substrates are put in position. The lamination of the two substrates can be accomplished by pressing the glass substrate together with the silicon substrate, such as with screws or with another means for pressing them together. An advantage of this method is that the substrates can be taken apart and repositioned easily if there is any misalignment.

An anodization joining process can be used if the goal is to laminate the silicon substrate and the glass substrate more securely. With this method, the silicon substrate and glass substrate are positioned and heated to 450° C. A direct current of 50 to 100 volts is then passed between the substrates to laminate them. This method affords a better seal than the resin bonding method discussed above.

When an electrical contact breaker switch is used alone, there is one glass substrate for each contact switch. When a plurality of contact breaker switches are manufactured as a set, there is one glass substrate for each set of contact breaker switches. In this case, the wiring may already be in place between the contact breaker switches. Dicing is performed for each glass substrate unit.

As discussed above, the device consistent with the present invention can be produced by the same process as a semiconductor device. For instance, when a four inch silicon substrate is used, approximately 3,000 contact breaker switches or more can be manufactured from the silicon substrate.

With the present invention, contact switching is accomplished by separating or merging a conductive fluid. Therefore, the switch contacts are not subjected to the physical or chemical changes on the electrode surfaces, such as metal fatigue or corrosion, that are encountered with a conventional device in which contact switching is accomplished by bringing exposed solid electrodes into contact with a conductive fluid. As a result, the reliability of the contact switching is extremely high. Also, the conductivity between the electrode components can be varied by changing the mechanism for modifying the form of the conductive fluid, such as discussed above in the first working example. Since this device does not have lead relays or other leads as in conventional designs, there is no change over time due to wear or any breakage due to mechanical fatigue.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electrical contact breaker switch that operates substantially independently of orientation, comprising:

a cavity, including a first channel and a second channel;

a pair of electrode components separated from each other, each electrode component having at least a portion within the cavity;

a conductive fluid, held within the first channel, that functions as a contact for putting the electrode components in a "closed" state when in contiguous form and in an "open" state when in non-contiguous form; and a non-conductive fluid supplied via the second channel for modifying the form of the conductive fluid between the contiguous form and the non-contiguous form.

2. An electrical contact breaker switch as defined in claim 1 additionally comprising a channel internal pressure control unit for varying the internal pressure of the first and second channels.

3. An electrical contact breaker switch as defined in claim 2, wherein the channel internal pressure control unit includes a heater.

4. An electrical contact breaker switch as defined in claim 2, wherein the channel internal pressure control unit includes a set of two chambers and each of the chambers is connected to a respective one of the first channel and the second channel.

5. An electrical contact breaker switch as defined in claim 1, wherein the portion of each electrode component within the cavity is continuously immersed in the conductive fluid.

6. An electrical contact breaker switch as defined in claim 1, wherein the electrode components include one of tungsten, molybdenum, chromium, titanium, tantalum, iron, cobalt, nickel, palladium, platinum, and a combination thereof.

7. An electrical contact breaker switch as defined in claim 1, wherein the conductive fluid includes one of mercury, gallium, and a sodium-potassium alloy.

8. An electrical contact breaker switch as defined in claim 1, comprising a non-conductive solid instead of the non-conductive fluid, and additionally comprising a mechanism for replacing part of the conductive fluid in contiguous form with the non-conductive solid to modify the form of the conductive fluid from the contiguous form to the non-contiguous form, and for removing the nonconductive solid that has replaced the part of the conductive fluid to modify the form of the conductive fluid from the non-contiguous form to the contiguous form.

9. An electrical contact breaker switch as defined in claim 1, wherein the non-conductive fluid is a gas including one of nitrogen, argon, helium, and hydrogen, or is a liquid including one of a fluorocarbon, an oil, an alcohol, and water.

10. An electrical contact breaker switch as defined in claim 1, wherein the cavity is formed by laminating a plurality of substrates.

11. An electrical contact breaker switch as defined in claim 10, wherein all of the plurality of substrates are semiconductor substrates, ceramic substrates, glass substrates or a combination thereof.

12. An electrical contact breaker switch as defined in claim 10, wherein the electrical contact breaker switch is formed by laminating two substrates, and the cavity is formed in at least one of the substrates.

13. An electrical contact breaker switch as defined in claim 10, wherein the electrical contact breaker switch is formed by laminating at least three substrates to form a laminate, and the cavity is formed in at least one of the substrates in surface contact with another substrate or is formed through communication openings in substrates located on the inside of the laminate.

14. An electrical contact breaker switch as defined in claim 10, wherein the first channel and the second channel are formed in the substrates.

15. An electrical contact breaker switch as defined in claim 1, wherein materials for forming structural elements of the electrical contact breaker switch are selected so that the conductive fluid and the non-conductive fluid do not chemically react with each other and do not chemically react with other structural elements.

16. An electrical contact breaker switch as defined in claim 1, wherein the cavity additionally includes at least one channel for receiving a part of the conductive fluid when the conductive fluid is in a non-contiguous form.

17. An electrical contact breaker switch as defined in claim 16, wherein the at least one channel includes a reservoir for holding the part of the conductive fluid received by the at least one channel.

18. An electrical contact breaker switch as defined in claim 16, wherein the cavity additionally includes a third channel for supplying the conductive fluid to put the electrode components in the "closed" state, the at least one channel intersects the third channel and the at least one channel includes a pin formed in a portion near the intersection with the third channel.

19. An electrical contact breaker switch as defined in claim 1, additionally comprising:

a second pair of electrode components separated from each other, each electrode component of the second pair of electrode components having at least a portion within the cavity, wherein the cavity includes an additional channel containing the conductive fluid, and the conductive fluid in each of the first channel and the additional channel functions as a contact for putting a respective pair of electrode components in a "closed" state when the conductive fluid is in the contiguous form.

20. An electrical contact breaker switch as defined in claim 1, wherein the cavity additionally includes a third channel for supplying the conductive fluid, the channel having a reservoir adjacent to at least one of the electrode components.

* * * * *